US007155845B2

(12) United States Patent
Durand

(10) Patent No.: US 7,155,845 B2
(45) Date of Patent: Jan. 2, 2007

(54) SOLE WITH EXTENSIBLE STRUCTURE FOOTWEAR EQUIPPED WITH SAME AND METHOD FOR MOUNTING SAME

(75) Inventor: Jean-Jacques Durand, Cholet (FR)

(73) Assignee: Exten.S, Cholet (FR)

( * ) Notice: Subject to any disclaimer, the term of this patent is extended or adjusted under 35 U.S.C. 154(b) by 227 days.

(21) Appl. No.: 10/475,933

(22) PCT Filed: Apr. 22, 2002

(86) PCT No.: PCT/FR02/01366

§ 371 (c)(1),
(2), (4) Date: Oct. 27, 2003

(87) PCT Pub. No.: WO02/087375

PCT Pub. Date: Nov. 7, 2002

(65) Prior Publication Data

US 2004/0128861 A1 Jul. 8, 2004

(30) Foreign Application Priority Data

Apr. 27, 2001 (FR) ..... 01 05702

(51) Int. Cl.

| | |
|---|---|
| ***A43B 13/00*** | (2006.01) |
| ***A43B 13/14*** | (2006.01) |
| ***A43B 5/00*** | (2006.01) |
| ***A43B 3/26*** | (2006.01) |
| ***A43B 13/28*** | (2006.01) |

(52) U.S. Cl. ..... 36/97; 36/25 R; 36/30 R
(58) Field of Classification Search ..... 36/97, 36/25 R, 28, 30 R, 31, 130

See application file for complete search history.

(56) References Cited

U.S. PATENT DOCUMENTS

| | | | | |
|---|---|---|---|---|
| 2,252,315 | A * | 8/1941 | Doree | 36/97 |
| 3,591,879 | A * | 7/1971 | Stapleton | 36/43 |
| 3,609,888 | A * | 10/1971 | Rickman | 36/130 |
| 3,624,930 | A | 12/1971 | Johnson et al. | |
| 3,629,961 | A | 12/1971 | Seif | |

(Continued)

FOREIGN PATENT DOCUMENTS

FR 993 360 10/1951

(Continued)

OTHER PUBLICATIONS

U.S. Appl. No. 60/304,250, filed Jul. 10, 2001.

(Continued)

*Primary Examiner*—Anthony Stashick
(74) *Attorney, Agent, or Firm*—Westerman, Hattori, Daniels & Adrian LLP

(57) ABSTRACT

Sole with stretchable structure, a footwear article provided with such a sole and its assembly method.

The invention relates to a footwear sole where the forepart is associated with a stretchable material making it possible to fit differing foot widths easily; it also relates to the footwear equipped with such a sole and the method for mounting this footwear.

It is constituted of a sole base (1) comprising openings (4) in which the lugs (3) of the stretchable part (2) are positioned in a sealed manner.

The insole (5) comprises a deformable structure (6) in its forepart. When the wearer's foot is put into a footwear article provided with such a complex, it exerts pressure on the edges of the upper (10) thus causing deformation of the sole. This ability of deforming the sole avoids feelings of compression of the foot.

The device according to the invention is intended in particular for the manufacture of footwear with the ability of adapting to differing foot anatomies.

15 Claims, 3 Drawing Sheets

U.S. PATENT DOCUMENTS 3,705,463 A 12/1972 Lown
3,724,105 A 4/1973 Weight
3,748,756 A 7/1973 White
3,834,046 A * 9/1974 Fowler ..... 36/30 R
3,916,539 A 11/1975 Pankin et al.
3,952,430 A 4/1976 Pankin et al.
4,215,493 A 8/1980 Antonious
4,270,285 A 6/1981 Antonious
4,451,995 A 6/1984 Antonious
4,506,460 A 3/1985 Rudy
4,541,184 A 9/1985 Leighton
4,551,930 A 11/1985 Graham et al.
4,559,723 A 12/1985 Hamy et al.
4,559,724 A 12/1985 Norton
4,590,123 A 5/1986 Hashimoto et al.
4,599,810 A 7/1986 Sacre
4,654,983 A 4/1987 Graham et al.
4,658,516 A 4/1987 Beck
4,724,624 A 2/1988 Duclos
4,910,887 A 3/1990 Turner et al.
4,944,099 A * 7/1990 Davis ..... 36/97
4,967,492 A 11/1990 Rosen
5,025,573 A 6/1991 Giese et al.
5,060,402 A 10/1991 Rosen
5,203,097 A 4/1993 Blair
5,337,492 A 8/1994 Anderie et al.
5,367,791 A 11/1994 Gross et al.
5,367,792 A 11/1994 Richard et al.
5,423,135 A 6/1995 Poole et al.
5,499,459 A 3/1996 Tomaro
5,529,830 A 6/1996 Dutta et al.
5,555,650 A 9/1996 Longbottom et al.
5,566,475 A 10/1996 Donnadieu
5,659,914 A 8/1997 Steinlauf
5,727,271 A 3/1998 Romanato et al.
5,729,912 A 3/1998 Gutkowski et al.
5,765,296 A 6/1998 Ludemann et al.
5,804,011 A 9/1998 Dutta et al.
5,813,145 A * 9/1998 Prober ..... 36/97
5,815,949 A * 10/1998 Sessa ..... 36/28
5,829,171 A 11/1998 Weber et al.
5,879,725 A 3/1999 Potter
5,893,219 A 4/1999 Smith et al.
5,915,820 A 6/1999 Kraeuter et al.
5,940,990 A 8/1999 Barret
5,946,825 A 9/1999 Koh et al.
5,948,707 A 9/1999 Crawley et al.
5,956,868 A * 9/1999 Stevens et al. ..... 36/97
5,983,524 A 11/1999 Polegato
5,996,253 A 12/1999 Spector
6,029,376 A 2/2000 Cass
6,050,001 A 4/2000 Ditrtrich
6,065,230 A 5/2000 James
6,105,279 A 8/2000 Bouchoms
6,115,945 A 9/2000 Ellis, III
6,119,373 A 9/2000 Gebhard et al.
6,122,844 A 9/2000 Nunez
6,138,385 A 10/2000 Jungkind et al.
D433,560 S 11/2000 Pawlus
6,205,683 B1 3/2001 Clark et al.
6,421,933 B1 * 7/2002 Zamprogno ..... 36/43
6,519,876 B1 2/2003 Geer et al.
6,920,707 B1 * 7/2005 Greene et al. ..... 36/97
6,976,319 B1 * 12/2005 Pfander ..... 36/30 R
2002/0088145 A1 7/2002 Clark et al.

FOREIGN PATENT DOCUMENTS

FR 1 218 101 5/1960
FR 2 501 480 9/1982
FR 2 675 349 10/1992
WO WO 96/18317 6/1996
WO WO 01/82733 11/2001
WO WO 02/051273 7/2002

OTHER PUBLICATIONS

U.S. Appl. No. 60/258,184, filed Dec. 22, 2000.
Acor Orthopaedic, Inc., SPR [online], http: // www. acor.com/srp. htm, [retrieved on Jun. 5, 2001], pp. 1/2-2/2.
Bontex, Our Products [online], http: //bontex.com/products.html, [retrieved Jun. 4, 2001], pp. 1/2-2/2.
International Preliminary Examination Report of PCT/US01/49381 (WO 02/051273).

* cited by examiner

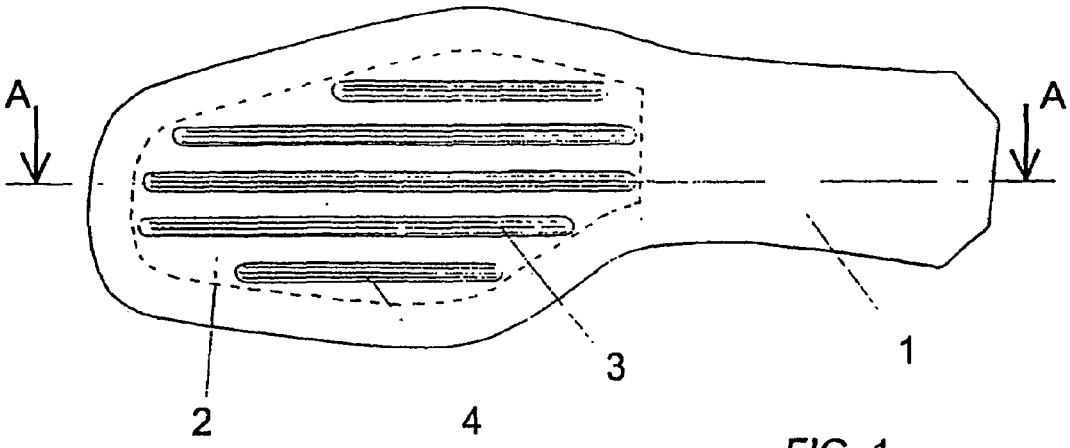
FIG. 1
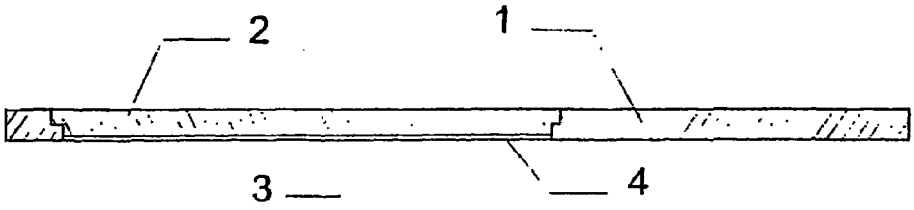
FIG. 2 - COUPE A-A

SOLE WITH EXTENSIBLE STRUCTURE FOOTWEAR EQUIPPED WITH SAME AND METHOD FOR MOUNTING SAME

The present invention relates to a sole of a shoe making it possible for different foot widths to be fitted easily; it also relates to the shoe equipped with such a sole together with the method for assembling this shoe.

Usually shoes are manufactured with a width chosen by the manufacturer. This width may be bigger or smaller but it is predetermined; it does not vary as a function of the width of the wearer's foot.

It is also known how to adapt to several foot widths by manufacturing an upper part in elastic material, but without being able to enlarge the lower part in contact with the sole.

The device according to the invention makes it possible to remedy these disadvantages. In fact, according to a first specification, it comprises a sole with at least one stretchable area in the forepart of the foot; thus, when worn, the manufactured shoe fits the anatomic width of the foot on its lower part.

In the shoe sole according to the invention, the transversally stretchable forepart is obtained by moulding (or gluing), on a sole base, one or several inserts of a material with deformable structure possessing an elasticity potential and a shape memory adapted to the comfort required. This stretchable insert is flat on the upper face and provided with one or several lugs on the lower face.

These lugs are intended to be set countersunk in the base of the sole. According to another specification, the sole base is manufactured from a classic type of material such as leather, elastomer, rubber, polyurethane or any other material used traditionally for the manufacture of shoe soles and possessing the normal abrasion resistance specifications.

According to another specification, the base of the sole comprises openings intended to receive the lugs of the lower face of the stretchable insert, while still preserving the sealing of the link between the two materials. According to another specification, an insole is constituted of one or several cut-out zones in the forepart of the foot and a rigid back part.

This structure of the forepart of the insole allows transversal deformation of the forepart zone.

Other embodiments of the insole can be envisaged. The deformable part of the forepart can be made simply by juxtaposition of longitudinal slits. According to another embodiment, the deformable part of the forepart can be obtained by producing one or several longitudinal openings, these being filled or not by moulding or gluing one or several inserts of stretchable material.

The invention also concerns the footwear article equipped with the stretchable sole as described above. According to a preferred embodiment, this footwear article is constituted of an upper, the insole with a deformable forepart and a rigid back part, of a non-glued sock lining in its peripheral part and of the stretchable insert sole according to the present invention.

When the user tries on a footwear article provided with such a complex, the foot exerts pressure on the edges of the upper, causing deformation of the insole and the sole. This ability of the sole and the insole to be deformed avoids any feeling of the foot being compressed.

The method of assembling this footwear article consists of preparing an insole with a rigid back part and a deformable part in the forepart area of the foot. Using a standard width last, the upper is mounted on said insole and glued on the sole equipped with its stretchable insert. Finally, the insole is set inside the shoe.

The invention is illustrated, without being limited in any way, by the description of a preferred embodiment, provided only as an example and shown in the attached drawings in which FIG. 1 represents the sole as seen from above.

FIG. 2 shows a longitudinal section of the sole.

Figure 3:
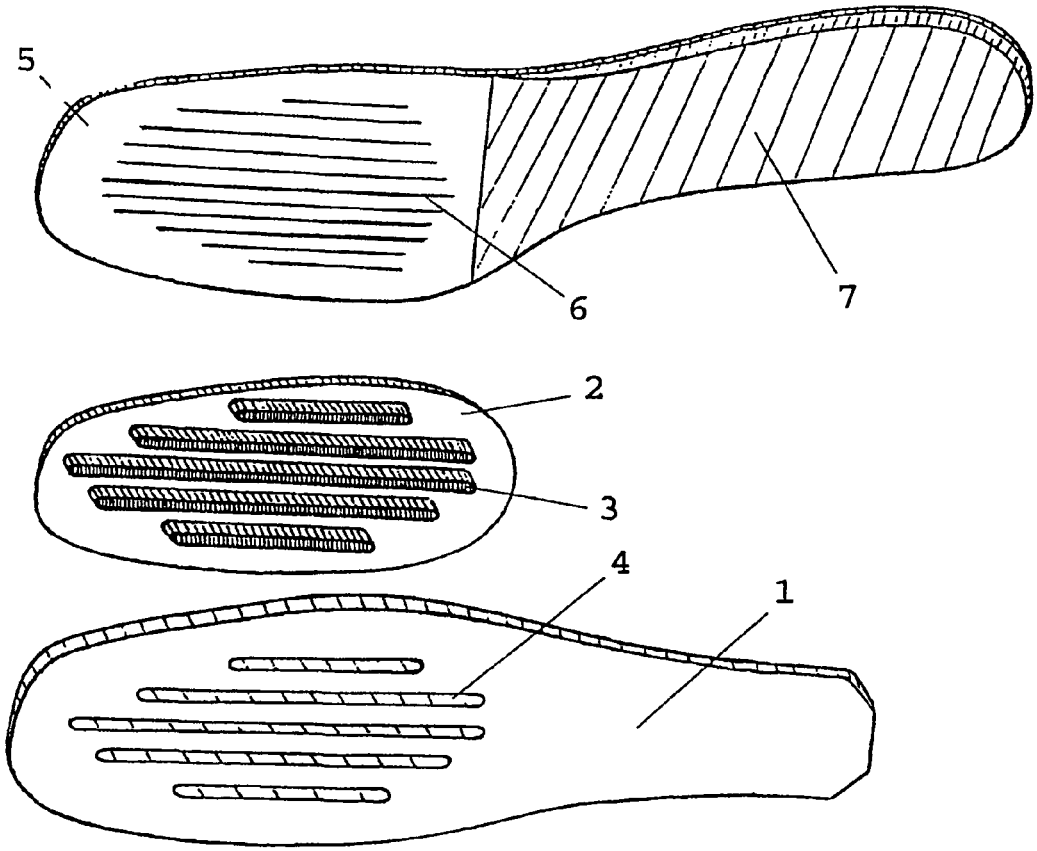
FIG. 3 shows an exploded view of the sole base, elastic insert and insole as a whole.

The sole shown in FIGS. 1 and 2 is constituted of a sole base 1 and of an insert in stretchable material 2, assembled by moulding or by gluing to ensure that there is a seal between the two materials. The lugs 3 of the stretchable insert are positioned in the openings 4 made in the base of the sole.

In the embodiment example shown, this type of implantation in parallel allows the addition of the elastic properties of each lug 3. This complex, with rigid sole base and stretchable insert makes it possible to obtain a sole that is sufficiently structured to be adapted to traditional soldering manufacture.

FIG. 3 shows a stack of independent supports with deformable and stretchable properties. The sole base 1 in rigid material is made deformable through the openings 4 made in the forepart area.

The insert 2 with lugs 3 which have been countersunk in the openings 4 of the sole base 1 is a stretchable sealed joint.

The insole 5 is equipped with a foot forepart made deformable by the presence of longitudinal slits 6 and a rigid back part 7.

Figure 4:
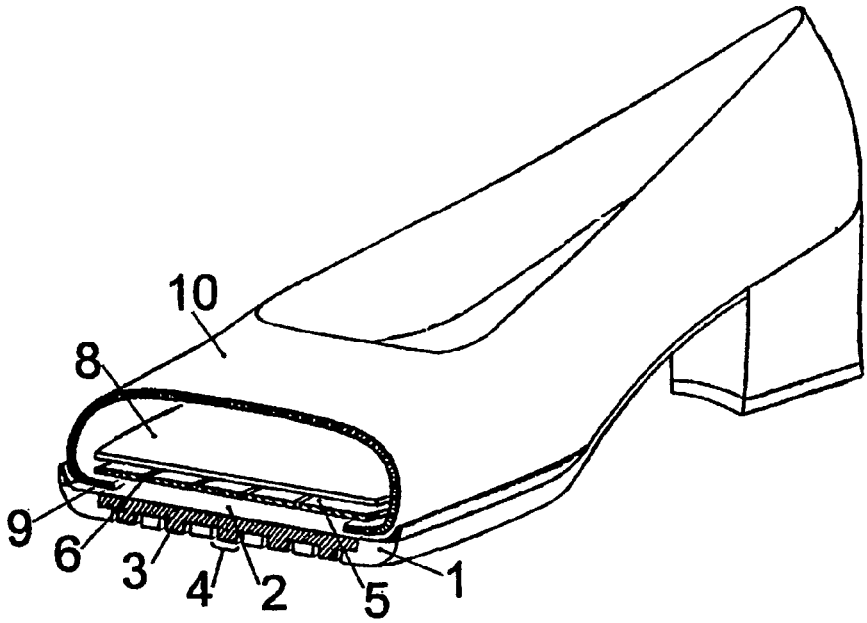
FIG. 4 shows a section in perspective of a shoe equipped with the system.

In the embodiment as a whole shown in FIG. 4, this configuration makes it possible to maintain elasticity at every stage once the assembly has been completed. The sole base 1, the insert 2 and the insole 5 possess stretchable properties outside the gluing zones 9.

The sock lining 8, non-glued at the periphery, does not block the deformation of the lower layers.

It is the pressure of the foot on the external edges of the upper 10 which produces the deformation of the superposed stretchable layers as a whole.

As a non-limiting example, the dimensions of the insert at the level of the lugs should be of the order of 3.5 mm in thickness and 7 mm in width.

It should be understood that these dimensions are only provided as indications; they can vary in function of the size and comfort required for the shoe.

This shoe structure provides walking comfort suitable, in particular, for "sensitive feet items", but evidently this stretchable structure can be envisaged for other types of assembly besides soldering or other types of footwear.

The present invention is intended, in particular, for the manufacture of shoes with the ability to adapt to varying foot widths.

The invention claimed is:

1. Stretchable sole for a shoe of the type where a sole base is adapted to be attached to edges of an upper, said stretchable sole comprising the sole base and an insert mounted to said base between the attachment zones of said base and of said upper, and wherein said insert is relatively stretchable transversally as compared to the sole base, wherein said insert is a moldable stretchable material with shape memorization and glued or soldered by injection on the sole base, said insert being provided with lugs on its lower surface and a forepart of said sole base being provided with openings into which the lugs are countersunk.

2. Stretchable sole according to claim 1, wherein the rigid sole base has properties suitable for gripping.

3. Stretchable sole according to claim 1, wherein the insert is glued or molded to the base.

4. Footwear comprising a stretchable sole according to claim 1 and an upper.

5. Footwear comprising a stretchable sole according to claim 1, wherein said footwear comprises an upper, an insole, a sock lining, the sole base and the stretchable sole insert, the insole being constituted of a deformable forepart and of a rigid back part.

6. Footwear according to claim 5, wherein the deformable forepart of the insole comprises parallel slits which have been made longitudinally in said part.

7. Method of assembly of footwear according to claim 5, comprising the following operations:

preparation of a sole sub-assembly, by assembling the sole base and the relatively stretchable insert, mounted to said base, preparation and assembly of the insole with its deformable foot forepart and its rigid back part, mounting of the upper on the insole, assembly of the sole subassembly with the mounted upper, setting of the sock lining on the upper face of the insole.

8. Method according to claim 7, wherein the insert is glued or molded to the base.

9. Stretchable sole according to claim 1, wherein the sole base has properties suitable for gripping.

10. Footwear comprising a stretchable sole according to claim 9, wherein said footwear comprises an upper, an insole, a sock lining, the sole base and the stretchable sole insert, the insole being constituted of a deformable forepart and of a rigid back part.

11. Footwear according to claim 10, wherein the deformable forepart of the insole comprises parallel slits which have been made longitudinally in said part.

12. Method of assembly of footwear according to claim 10, comprising the following operations:

preparation of a sole sub-assembly, by assembling the sole base and the relatively stretchable insert, mounted to said base, preparation and assembly of the insole with its deformable foot forepart and its rigid back part, mounting of the upper on the insole, assembly of the sole subassembly with the mounted upper, setting of the sock lining on the upper face of the insole.

13. Footwear comprising a stretchable sole according to claim 1, wherein said footwear comprises an upper, an insole, a sock lining, the sole base and the stretchable sole insert, the insole being constituted of a deformable forepart and of a rigid back part.

14. Footwear according to claim 13, wherein the deformable forepart of the insole comprises parallel slits which have been made longitudinally in said part.

15. Method of assembly of footwear according to claim 13, comprising the following operations:

preparation of a sole sub-assembly, by assembling the sole base and the relatively stretchable insert, mounted to said base, preparation and assembly of the insole with its deformable foot forepart and its rigid back part, mounting of the upper on the insole, assembly of the sole subassembly with the mounted upper, setting of the sock lining on the upper face of the insole.

* * * * *